US009704665B2

(12) United States Patent
Brock et al.

(10) Patent No.: US 9,704,665 B2
(45) Date of Patent: Jul. 11, 2017

(54) BACKLIT KEYBOARD INCLUDING REFLECTIVE COMPONENT

(71) Applicant: Apple Inc., Cupertino, CA (US)

(72) Inventors: John M. Brock, San Francisco, CA (US); Robert S. Murphy, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/281,136

(22) Filed: May 19, 2014

(65) Prior Publication Data

US 2015/0332874 A1 Nov. 19, 2015

(51) Int. Cl.
*H01H 13/70* (2006.01)
*H01H 11/00* (2006.01)
(Continued)

(52) U.S. Cl.
CPC ..... *H01H 11/00* (2013.01); *H01H 13/702* (2013.01); *H01H 13/83* (2013.01); *H01H 2219/06* (2013.01); *Y10T 29/49107* (2015.01)

(58) Field of Classification Search
CPC ..... H01H 13/70; H01H 13/83; H01H 13/023; H01H 3/12; G02B 6/0011; B41J 5/10; B41J 5/105
(Continued)

(56) References Cited

U.S. PATENT DOCUMENTS 3,657,492 A 4/1972 Arndt et al.
3,917,917 A 11/1975 Murata
(Continued)

FOREIGN PATENT DOCUMENTS

CN 2155620 2/1994
CN 2394309 8/2000
(Continued)

OTHER PUBLICATIONS

U.S. Appl. No. 15/014,596, filed Feb. 3, 2016, pending.
(Continued)

*Primary Examiner* — Vanessa Girardi
(74) *Attorney, Agent, or Firm* — Brownstein Hyatt Farber Schreck, LLP

(57) ABSTRACT

A backlit keyboard including a reflective component. The backlit keyboard may include a top case forming a top portion of an exterior surface of the keyboard. The backlit keyboard may further include a set of keys positioned within the top case and a membrane positioned below the set of keys. The backlit keyboard may further include a light guide positioned below the membrane and a light source positioned on a portion of the light guide. The light source may be configured to emit light coupled into the light guide and emit stray light not coupled into the light guide. The backlit keyboard may further include a bottom case attached to the top case and forming a bottom portion of the exterior surface of the keyboard. Additionally, the backlit keyboard may include a reflector positioned on an interior surface of the bottom case below the light guide and separated from the light guide by a gap. In some embodiments, the reflector may be configured to redirect the stray light towards the set of keys and provide structural support for the light guide.

13 Claims, 8 Drawing Sheets

(51) Int. Cl.
*H01H 13/702* (2006.01)
*H01H 13/83* (2006.01)

(58) Field of Classification Search
USPC ..... 200/5 A, 310, 314; 345/170; 361/679.08; 362/558, 560; 400/490
See application file for complete search history.

(56) References Cited

U.S. PATENT DOCUMENTS 4,095,066 A 6/1978 Harris
4,319,099 A 3/1982 Asher
4,349,712 A 9/1982 Michalski
4,484,042 A 11/1984 Matsui
4,598,181 A 7/1986 Selby
4,755,645 A 7/1988 Naoki et al.
4,937,408 A 6/1990 Hattori et al.
5,136,131 A 8/1992 Komaki
5,278,372 A 1/1994 Takagi et al.
5,340,955 A 8/1994 Calvillo et al.
5,382,762 A 1/1995 Mochizuki
5,421,659 A 6/1995 Liang
5,422,447 A 6/1995 Spence
5,457,297 A 10/1995 Chen
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,878,872 A 3/1999 Tsai
5,881,866 A 3/1999 Miyajima et al.
5,935,691 A 8/1999 Tsai
5,986,227 A 11/1999 Hon
6,020,565 A 2/2000 Pan
6,215,420 B1 4/2001 Harrison et al.
6,257,782 B1 7/2001 Maruyama et al.
6,388,219 B2 5/2002 Hsu et al.
6,482,032 B1 11/2002 Szu et al.
6,530,283 B2 3/2003 Okada et al.
6,538,801 B2 3/2003 Jacobson et al.
6,542,355 B1 4/2003 Huang
6,552,287 B2 4/2003 Janniere
6,556,112 B1 4/2003 Van Zeeland et al.
6,559,399 B2 5/2003 Hsu et al.
6,572,289 B2 6/2003 Lo et al.
6,624,369 B2 9/2003 Ito et al.
6,750,414 B2 6/2004 Sullivan
6,759,614 B2 7/2004 Yoneyama
6,762,381 B2 7/2004 Kunthady et al.
6,788,450 B2 9/2004 Kawai et al.
6,797,906 B2 9/2004 Ohashi
6,850,227 B2 2/2005 Takahashi et al.
6,926,418 B2 8/2005 Osterg.ang.rd et al.
6,940,030 B2 9/2005 Takeda et al.
6,977,352 B2 12/2005 Oosawa
6,979,792 B1 12/2005 Lai
6,987,466 B1 1/2006 Welch et al.
6,987,503 B2 1/2006 Inoue
7,012,206 B2 3/2006 Oikawa
7,038,832 B2 5/2006 Kanbe
7,129,930 B1 10/2006 Cathey et al.
7,134,205 B2 11/2006 Bruennel
7,146,701 B2 12/2006 Mahoney et al.
7,151,236 B2 12/2006 Ducruet et al.
7,151,237 B2 12/2006 Mahoney et al.
7,154,059 B2 12/2006 Chou
7,166,813 B2 1/2007 Soma
7,172,303 B2 2/2007 Shipman et al.
7,189,932 B2 3/2007 Kim
7,256,766 B2 8/2007 Albert et al.
7,283,119 B2 10/2007 Kishi
7,301,113 B2 11/2007 Nishimura et al.
7,378,607 B2 5/2008 Koyano et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,639,187 B2 12/2009 Caballero et al.
7,679,010 B2 3/2010 Wingett
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,947,915 B2 5/2011 Lee et al.
7,999,748 B2 8/2011 Ligtenberg et al.
8,063,325 B2 11/2011 Sung et al.
8,080,744 B2 12/2011 Yeh et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,143,982 B1 3/2012 Lauder et al.
8,156,172 B2 4/2012 Muehl et al.
8,212,160 B2 7/2012 Tsao
8,212,162 B2 7/2012 Zhou
8,218,301 B2 7/2012 Lee
8,232,958 B2 7/2012 Tolbert
8,253,048 B2 8/2012 Ozias et al.
8,253,052 B2 8/2012 Chen
8,263,887 B2 9/2012 Chen et al.
8,289,280 B2 10/2012 Travis
8,299,382 B2 10/2012 Takemae et al.
8,317,384 B2 11/2012 Chung et al.
8,319,298 B2 11/2012 Hsu
8,330,725 B2 12/2012 Mahowald et al.
8,354,629 B2 1/2013 Lin
8,378,857 B2 2/2013 Pance
8,383,972 B2 2/2013 Liu
8,384,566 B2 2/2013 Bocirnea
8,404,990 B2 3/2013 Lutgring et al.
8,436,265 B2 5/2013 Koike et al.
8,451,146 B2 5/2013 Mahowald et al.
8,462,514 B2 6/2013 Myers et al.
8,500,348 B2 8/2013 Dumont et al.
8,542,194 B2 9/2013 Akens et al.
8,569,639 B2 10/2013 Strittmatter
8,581,127 B2 11/2013 Jhuang et al.
8,592,699 B2 11/2013 Kessler et al.
8,592,702 B2 11/2013 Tsai
8,592,703 B2 11/2013 Johnson et al.
8,604,370 B2 12/2013 Chao
8,629,362 B1 1/2014 Knighton et al.
8,651,720 B2 2/2014 Sherman et al.
8,659,882 B2 2/2014 Liang et a.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,786,548 B2 7/2014 Oh et al.
8,791,378 B2 7/2014 Lan
8,835,784 B2 9/2014 Hirota
8,847,711 B2 9/2014 Yang et al.
8,854,312 B2 10/2014 Meierling
8,870,477 B2 10/2014 Merminod et al.
8,884,174 B2 11/2014 Chou et al.
8,921,473 B1 12/2014 Hyman
8,922,476 B2 12/2014 Stewart et al.
8,976,117 B2 3/2015 Krahenbuhl et al.
8,994,641 B2 3/2015 Stewart et al.
9,007,297 B2 4/2015 Stewart et al.
9,063,627 B2 6/2015 Yairi et al.
9,086,733 B2 7/2015 Pance
9,087,663 B2 7/2015 Los
9,213,416 B2 12/2015 Chen
9,223,352 B2 12/2015 Smith et al.
9,234,486 B2 1/2016 Das et al.
9,235,236 B2 1/2016 Nam
9,275,810 B2 3/2016 Pance et al.

(56) References Cited

U.S. PATENT DOCUMENTS

| | | | | |
|---|---|---|---|---|
| 9,300,033 | B2 | 3/2016 | Han et al. | |
| 9,305,496 | B2 | 4/2016 | Kimura | |
| 9,443,672 | B2 | 9/2016 | Martisauskas | |
| 2002/0079211 | A1 | 6/2002 | Katayama et al. | |
| 2002/0093436 | A1 | 7/2002 | Lien | |
| 2002/0149835 | A1 | 10/2002 | Kanbe | |
| 2003/0169232 | A1 | 9/2003 | Ito | |
| 2004/0257247 | A1 | 12/2004 | Lin et al. | |
| 2006/0011458 | A1 | 1/2006 | Purcocks | |
| 2006/0020469 | A1 | 1/2006 | Rast | |
| 2006/0120790 | A1 | 6/2006 | Chang | |
| 2006/0181511 | A1 | 8/2006 | Woolley | |
| 2006/0243987 | A1 | 11/2006 | Lai | |
| 2007/0200823 | A1 | 8/2007 | Bytheway et al. | |
| 2007/0285393 | A1 | 12/2007 | Ishakov | |
| 2008/0131184 | A1 | 6/2008 | Brown et al. | |
| 2008/0136782 | A1* | 6/2008 | Mundt | G06F 1/1662 345/170 |
| 2009/0046053 | A1 | 2/2009 | Shigehiro et al. | |
| 2009/0103964 | A1 | 4/2009 | Takagi et al. | |
| 2009/0128496 | A1 | 5/2009 | Huang | |
| 2009/0262085 | A1 | 10/2009 | Wassingbo et al. | |
| 2010/0066568 | A1 | 3/2010 | Lee | |
| 2010/0156796 | A1 | 6/2010 | Kim et al. | |
| 2010/0213044 | A1 | 8/2010 | Strittmatter et al. | |
| 2010/0253630 | A1 | 10/2010 | Homma et al. | |
| 2011/0032127 | A1 | 2/2011 | Roush | |
| 2011/0056817 | A1 | 3/2011 | Wu | |
| 2011/0056836 | A1 | 3/2011 | Tatebe et al. | |
| 2011/0203912 | A1 | 8/2011 | Niu et al. | |
| 2011/0205179 | A1 | 8/2011 | Braun | |
| 2011/0267272 | A1 | 11/2011 | Meyer et al. | |
| 2011/0303521 | A1 | 12/2011 | Niu et al. | |
| 2012/0012446 | A1 | 1/2012 | Hwa | |
| 2012/0080300 | A1* | 4/2012 | Chen | 200/5 A |
| 2012/0090973 | A1 | 4/2012 | Liu | |
| 2012/0098751 | A1 | 4/2012 | Liu | |
| 2012/0168294 | A1 | 7/2012 | Pegg | |
| 2012/0193202 | A1 | 8/2012 | Chen | |
| 2012/0286701 | A1 | 11/2012 | Yang et al. | |
| 2012/0313856 | A1 | 12/2012 | Hsieh | |
| 2013/0100030 | A1 | 4/2013 | Los et al. | |
| 2013/0162450 | A1 | 6/2013 | Leong et al. | |
| 2013/0270090 | A1 | 10/2013 | Lee | |
| 2014/0071654 | A1 | 3/2014 | Chien et al. | |
| 2014/0090967 | A1 | 4/2014 | Inagaki | |
| 2014/0098042 | A1 | 4/2014 | Kuo et al. | |
| 2014/0116865 | A1 | 5/2014 | Leong et al. | |
| 2014/0118264 | A1 | 5/2014 | Leong et al. | |
| 2014/0151211 | A1* | 6/2014 | Zhang | 200/5 A |
| 2014/0218851 | A1 | 8/2014 | Klein et al. | |
| 2014/0251772 | A1 | 9/2014 | Welch et al. | |
| 2014/0252881 | A1 | 9/2014 | Dinh et al. | |
| 2014/0291133 | A1 | 10/2014 | Fu et al. | |
| 2014/0320436 | A1 | 10/2014 | Modarres et al. | |
| 2014/0346025 | A1 | 11/2014 | Hendren et al. | |
| 2014/0375141 | A1 | 12/2014 | Nakajima | |
| 2015/0016038 | A1 | 1/2015 | Niu et al. | |
| 2015/0083561 | A1 | 3/2015 | Han et al. | |
| 2015/0090570 | A1 | 4/2015 | Kwan et al. | |
| 2015/0090571 | A1 | 4/2015 | Leong et al. | |
| 2015/0227207 | A1 | 8/2015 | Winter et al. | |
| 2015/0243457 | A1 | 8/2015 | Niu et al. | |
| 2015/0270073 | A1 | 9/2015 | Yarak, III et al. | |
| 2015/0277559 | A1 | 10/2015 | Vescovi et al. | |
| 2015/0287553 | A1 | 10/2015 | Welch et al. | |
| 2015/0348726 | A1 | 12/2015 | Hendren | |
| 2015/0378391 | A1 | 12/2015 | Huitema et al. | |
| 2016/0049266 | A1 | 2/2016 | Stringer et al. | |
| 2016/0093452 | A1 | 3/2016 | Zercoe et al. | |
| 2016/0172129 | A1 | 6/2016 | Zercoe et al. | |
| 2016/0189890 | A1 | 6/2016 | Leong et al. | |
| 2016/0189891 | A1 | 6/2016 | Zercoe et al. | |

FOREIGN PATENT DOCUMENTS

| | | |
|---|---|---|
| CN | 1533128 | 9/2004 |
| CN | 1542497 | 11/2004 |
| CN | 2672832 | 1/2005 |
| CN | 1624842 | 6/2005 |
| CN | 1812030 | 8/2006 |
| CN | 1855332 | 11/2006 |
| CN | 101051569 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102375550 | 3/2012 |
| CN | 202205161 | 4/2012 |
| CN | 102496509 | 6/2012 |
| CN | 10269527 | 8/2012 |
| CN | 202372927 | 8/2012 |
| CN | 102683072 | 9/2012 |
| CN | 202434387 | 9/2012 |
| CN | 202523007 | 11/2012 |
| CN | 102955573 | 3/2013 |
| CN | 102956386 | 3/2013 |
| CN | 103000417 | 3/2013 |
| CN | 103165327 | 6/2013 |
| CN | 103180979 | 6/2013 |
| CN | 203012648 | 6/2013 |
| CN | 103377841 | 10/2013 |
| CN | 103489986 | 1/2014 |
| CN | 103681056 | 3/2014 |
| CN | 203520312 | 4/2014 |
| CN | 203588895 | 5/2014 |
| CN | 103839715 | 6/2014 |
| CN | 103839720 | 6/2014 |
| CN | 103839722 | 6/2014 |
| CN | 103903891 | 7/2014 |
| CN | 103956290 | 7/2014 |
| CN | 204102769 | 1/2015 |
| DE | 2530176 | 1/1977 |
| DE | 3002772 | 7/1981 |
| DE | 29704100 | 4/1997 |
| EP | 0441993 | 8/1991 |
| EP | 1835272 | 9/2007 |
| EP | 1928008 | 6/2008 |
| EP | 2022606 | 6/2010 |
| EP | 2426688 | 3/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | S61172422 | 10/1986 |

(56) References Cited

FOREIGN PATENT DOCUMENTS

| | | |
|---|---|---|
| JP | S62072429 | 4/1987 |
| JP | S63182024 | 11/1988 |
| JP | H0422024 | 4/1992 |
| JP | H0520963 | 1/1993 |
| JP | H0524512 | 8/1993 |
| JP | H05342944 | 12/1993 |
| JP | H09204148 | 8/1997 |
| JP | H10312726 | 11/1998 |
| JP | H11194882 | 7/1999 |
| JP | 2000010709 | 1/2000 |
| JP | 2000057871 | 2/2000 |
| JP | 2000339097 | 12/2000 |
| JP | 2001100889 | 4/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006269439 | 10/2006 |
| JP | 2006277013 | 10/2006 |
| JP | 2006344609 | 12/2006 |
| JP | 2007115633 | 5/2007 |
| JP | 2007514247 | 5/2007 |
| JP | 2007156983 | 6/2007 |
| JP | 2008021428 | 1/2008 |
| JP | 2008041431 | 2/2008 |
| JP | 2008100129 | 5/2008 |
| JP | 2008191850 | 8/2008 |
| JP | 2008533559 | 8/2008 |
| JP | 2009099503 | 5/2009 |
| JP | 2009181894 | 8/2009 |
| JP | 2010061956 | 3/2010 |
| JP | 2010244088 | 10/2010 |
| JP | 2010244302 | 10/2010 |
| JP | 2011065126 | 3/2011 |
| JP | 2011150804 | 8/2011 |
| JP | 2011165630 | 8/2011 |
| JP | 2011524066 | 8/2011 |
| JP | 2012043705 | 3/2012 |
| JP | 2012063630 | 3/2012 |
| JP | 2012098873 | 5/2012 |
| JP | 2012134064 | 7/2012 |
| JP | 2012186067 | 9/2012 |
| JP | 2012230256 | 11/2012 |
| JP | 2014017179 | 1/2014 |
| JP | 2014216190 | 11/2014 |
| JP | 2014220039 | 11/2014 |
| KR | 1019990007394 | 1/1999 |
| KR | 1020020001668 | 1/2002 |
| KR | 100454203 | 10/2004 |
| KR | 1020060083032 | 7/2006 |
| KR | 1020080064116 | 7/2008 |
| KR | 1020080066164 | 7/2008 |
| KR | 2020110006385 | 6/2011 |
| KR | 1020120062797 | 6/2012 |
| KR | 1020130040131 | 4/2013 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO2006/022313 | 3/2006 |
| WO | WO2008/045833 | 4/2008 |
| WO | WO2009/005026 | 1/2009 |
| WO | WO2012/011282 | 1/2012 |
| WO | WO2012/027978 | 3/2012 |
| WO | WO2013/096478 | 6/2013 |
| WO | WO2014175446 | 10/2014 |

OTHER PUBLICATIONS

U.S. Appl. No. 15/154,682, filed May 13, 2016, pending.
U.S. Appl. No. 15/154,706, filed May 13, 2016, pending.
U.S. Appl. No. 15/154,723, filed May 13, 2016, pending.
U.S. Appl. No. 15/154,768, filed May 13, 2016, pending.
U.S. Appl. No. 15/230,740, filed Aug. 8, 2016, pending.
U.S. Appl. No. 15/230,724, filed Aug. 8, 2016, pending.
U.S. Appl. No. 15/261,954, filed Sep. 11, 2016, pending.
U.S. Appl. No. 15/261,972, filed Sep. 11, 2016, pending.
U.S. Appl. No. 15/262,249, filed Sep. 12, 2016, pending.
U.S. Appl. No. 15/264,827, filed Sep. 14, 2016, pending.
U.S. Appl. No. 15/268,518, filed Sep. 16, 2016, pending; and.
U.S. Appl. No. 15/269,790, filed Sep. 19, 2016, pending.
Elekson, "Reliable and Tested Wearable Electronics Embedment Solutions," http://www.wearable.technology/our-technologies, 3 pages, at least as early as Jan. 6, 2016.

* cited by examiner

BACKLIT KEYBOARD INCLUDING REFLECTIVE COMPONENT

TECHNICAL FIELD

The disclosure relates generally to electronic devices, and more particularly to input devices for electronic devices.

BACKGROUND

Conventional electronic devices typically include one or more input devices such as keyboards, buttons, touchpads or touchscreens. These input devices allow a user to interact with the electronic device. For example, a keyboard of an electronic device may allow a user to perform data entry processes on the electronic device. The input devices typically used with conventional electronic devices may be stand alone, or may be integral with the electronic device. The input devices for conventional electronic devices may also include a variety of features for ease of use by a user. For example, a keyboard for a conventional electronic device may include a backlighting feature. The backlighting feature may illuminate at least a portion of the keyboard, including the key glyphs and/or the boarders of each individual key. By illuminating at least a portion of the keyboard, visibility and/or usability of the keyboard may increase in low light usage of the electronic device.

Conventional backlit keyboards include a plurality of internal layers, often referred to as "stack ups," which may create the backlit feature. To couple the various layers forming the stack up of the conventional backlit keyboard, an adhesive is typically used. However, the use of an adhesive to couple the layers may decrease the efficiency in transmitting light within the keyboard assembly as a layer of the assembly's (e.g., light guide) ability to channel or redirect light toward a key of the keyboard assembly may be substantially diminished. As such, conventional keyboards typically include a minimal amount of adhesive to couple the various layers of the stack up. However, with a decrease in the amount of adhesive applied, the stack up is less likely to remain structurally intact. That is, due to the minimal amount of adhesive used on the backlit keyboard assembly, the various layers of the backlit keyboard may be inadequately coupled and/or may not include a desired structural support. As a result of the inadequate coupling and/or inadequate structural support, the stack up for the backlit keyboard may become disconnected overtime and may result in improper function of the backlit keyboard for the electronic device.

SUMMARY

Generally, embodiments discussed herein are related to a backlit keyboard, an electronic device including a backlit keyboard assembly, and a method for assembling a backlit keyboard. The backlit keyboard may include a metal reflective component or reflective layer positioned adjacent to a light guide layer including a light source. The metal reflective component may include reflective properties and may provide a substantially rigid end structure for the various internal layers forming the keyboard. That is, the metal reflective component may reflect stray light back toward the light guide of the keyboard assembly, and may act as a substantially rigid internal end layer of the various layers forming the keyboard. In reflecting stray light back toward the light guide, the metal reflective component may increase the amount of light that may be provided to the keys of the backlit keyboard. Additionally, by including rigid structural properties, the metal reflective component may be coupled to distinct portions of the key board, and may provide additional support/coupling for the various internal layers forming the keyboard assembly. More specifically, the metal reflective component may provide support for the various internal layers of the keyboard assembly and may provide a compression fit to hold the layers together within the keyboard. The metal reflective component may provide the added support to the various internal layers by being coupled, permanently or temporarily, to the top case and/or a metal feature plate included within the keyboard assembly. As a result, the various internal layers forming the keyboard assembly that may be positioned adjacent the metal reflective component may rely solely on the metal reflective component for holding them in place, and may not require additional coupling components or techniques, which may require additional space and/or additional components within the keyboard assembly.

One embodiment may include a backlit keyboard. The backlit keyboard may include a top case, and a plurality of keys positioned adjacent a membrane. The plurality of keys may also be positioned within the top case. The keyboard may also include a metal feature plate positioned adjacent the membrane, and a light guide positioned adjacent the metal feature plate. The backlit keyboard may also include a light source positioned on a portion of the light guide. Additionally, the keyboard may include a metal reflective component positioned adjacent the light guide. The metal reflective component may be coupled to one of: the top case, or the metal feature plate. Additionally, the metal reflective component may provide structural support to at least one of the membrane, the metal feature plate and the light guide.

Another embodiment may include an electronic device. The electronic device may include a top case and a keyboard assembly. The keyboard assembly of the electronic device may include a top case, and a keyboard assembly positioned within the top case. The keyboard assembly may include a plurality of keys positioned adjacent a first side of a membrane, a metal feature plate positioned adjacent a second side of the membrane, and a metal reflective component positioned adjacent a light guide positioned between the metal feature plate and the metal reflective component. The metal reflective component may be coupled to one of: the top case, or the metal feature plate of the keyboard assembly.

A further embodiment may include a method of assembling a keyboard. The method may include positioning a light guide adjacent to a metal feature plate positioned adjacent to a membrane. The membrane may be positioned between the metal feature plate and a top case surrounding a plurality of keys. The method may also include positioning a metal reflective component adjacent the light guide, and coupling the metal reflective component to at least one of: the top case, or the metal feature plate.

BRIEF DESCRIPTION OF THE DRAWINGS

The disclosure will be readily understood by the following detailed description in conjunction with the accompanying drawings, wherein like reference numerals designate like structural elements, and in which.

Figure 1:
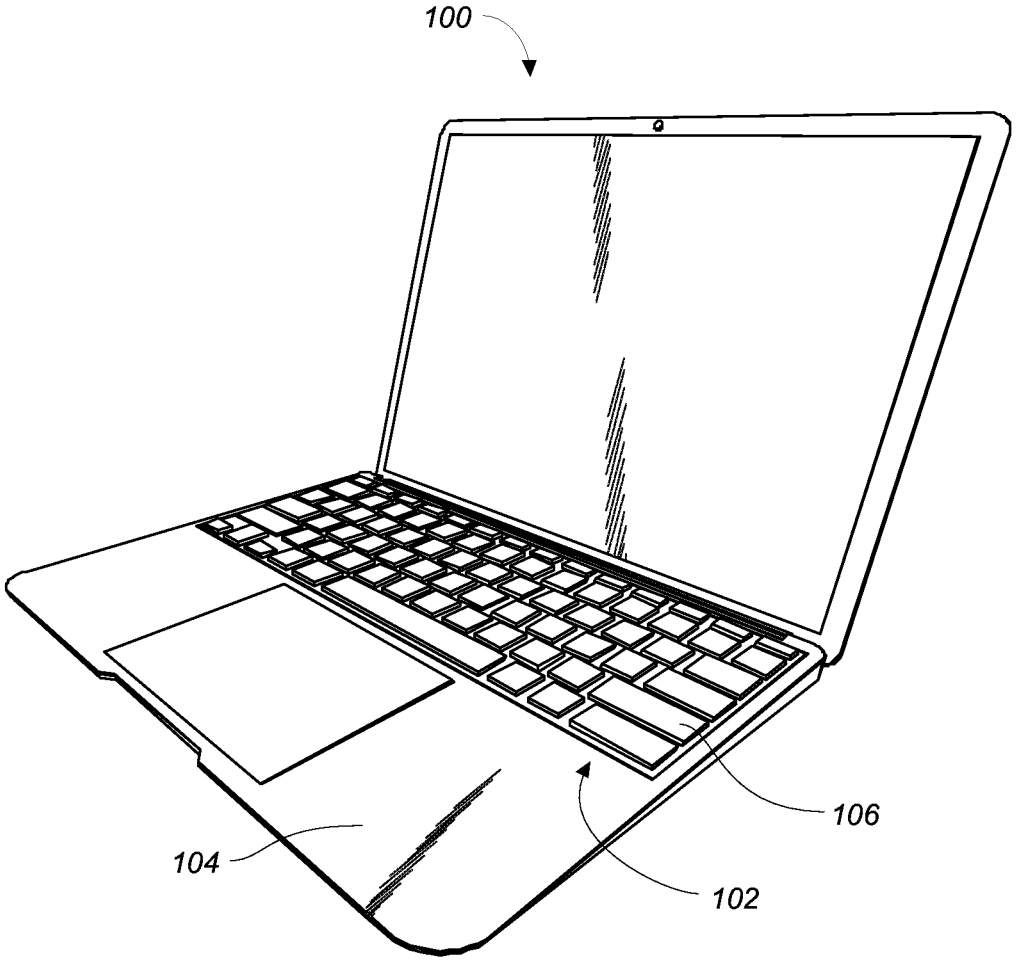
FIG. 1 shows an illustrative perspective view of an electronic device including a backlit keyboard assembly, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to electronic devices, and more particularly, to input devices for electronic devices.

The backlit keyboard may include a metal reflective component or reflective layer positioned adjacent to a light guide layer and a light source positioned on the light guide layer. The metal reflective component may have reflective properties and, in some embodiments, may provide a substantially rigid end structure for the various internal layers forming the keyboard. That is, the metal reflective component may reflect stray light back toward the light guide of the keyboard assembly, and optionally may act as a substantially rigid internal end layer of the various layers forming the keyboard. In reflecting stray light back toward the light guide, the metal reflective component may increase the amount of light that may be provided to the keys of the backlit keyboard.

Additionally, by including rigid structural properties, the metal reflective component may be coupled to distinct portions of the keyboard, and may provide additional support/coupling for the various internal layers forming the keyboard assembly. More specifically, the metal reflective component may provide support for the various internal layers of the keyboard assembly and may provide a compression fit to hold the layers together within the keyboard. The metal reflective component may provide added support to the various internal layers by being coupled, permanently or temporarily, to the top case and/or a metal feature plate included within the keyboard assembly. As a result, in some embodiments the various internal layers forming the keyboard assembly that may be positioned adjacent the metal reflective component may rely solely on the metal reflective component for holding them in place, and may not require additional coupling components or techniques, which may require additional space and/or additional components within the keyboard assembly.

These and other embodiments are discussed below with reference to FIGS. 1-6. However, those skilled in the art will readily appreciate that the detailed description given herein with respect to these Figures is for explanatory purposes only and should not be construed as limiting.

FIG. 1 shows an illustrative perspective view of an electronic device 100 including a backlit keyboard assembly 102, according to embodiments. In a non-limiting example, as shown in FIG. 1, electronic device 100 may be a laptop computer. However, it is understood that electronic device 100 may be configured as any suitable electronic device that may utilize backlit keyboard assembly 102. More specifically, other embodiments can implement electronic device 100 differently, such as, for example, a desktop computer, a tablet computing device, a smartphone, a gaming device, a display, a digital music player, a wearable computing device or display, a health monitoring device, and so on.

Although discussed herein as a keyboard assembly, it is understood that the disclosed embodiments may be used in a variety of input devices used in various electronic devices. That is, backlit keyboard assembly 102, and the components of the assembly discussed herein, may be utilized or implemented in a variety of input devices for an electronic device including, but not limited to: buttons, switches, toggles, wheels, and touch screens.

Electronic device 100 may include a top case 104. Top case 104 may take the form of an exterior, protective casing or shell for electronic device 100 and the various internal components (for example, back lit keyboard assembly 102) of electronic device 100. Top case 104 may be formed as a single, integral component, or may have a plurality of distinct components that may be configured to be coupled to one another, as discussed herein. Additionally, top case 104 may be formed from any suitable material that provides a protective casing or shell for electronic device 100 and the various components included in electronic device 100. In non-limiting examples, top case 104 may be made from metal, a ceramic, a rigid plastic or another polymer, a fiber-matrix composite, and so on.

Backlit keyboard assembly 102 may be included within electronic device 100. More specifically, as shown in FIG. 1, backlit keyboard assembly 102 may include a plurality of keys 106 positioned within top case 104 of electronic device 100. The plurality of keys 106 may partially protrude from top case 104, and each may be substantially surrounded by top case 104. That is, the plurality of keys 106 of backlit keyboard assembly 102 may extend beyond a surface of top case 104, and may be divided or separated by a portion of top case 104. In the non-limiting example shown in FIG. 1, where electronic device 100 is a laptop computer, backlit keyboard assembly 102 may be positioned within and/or may be received by electronic device 100. In an additional embodiment, backlit keyboard assembly 102 may be a distinct, standalone component, and may be in electronic communication (for example, wired, wireless, Bluetooth, etc.) with electronic device 100. Backlit keyboard assembly 102 may be configured to allow a user to interact with electronic device 100.

Figure 2:
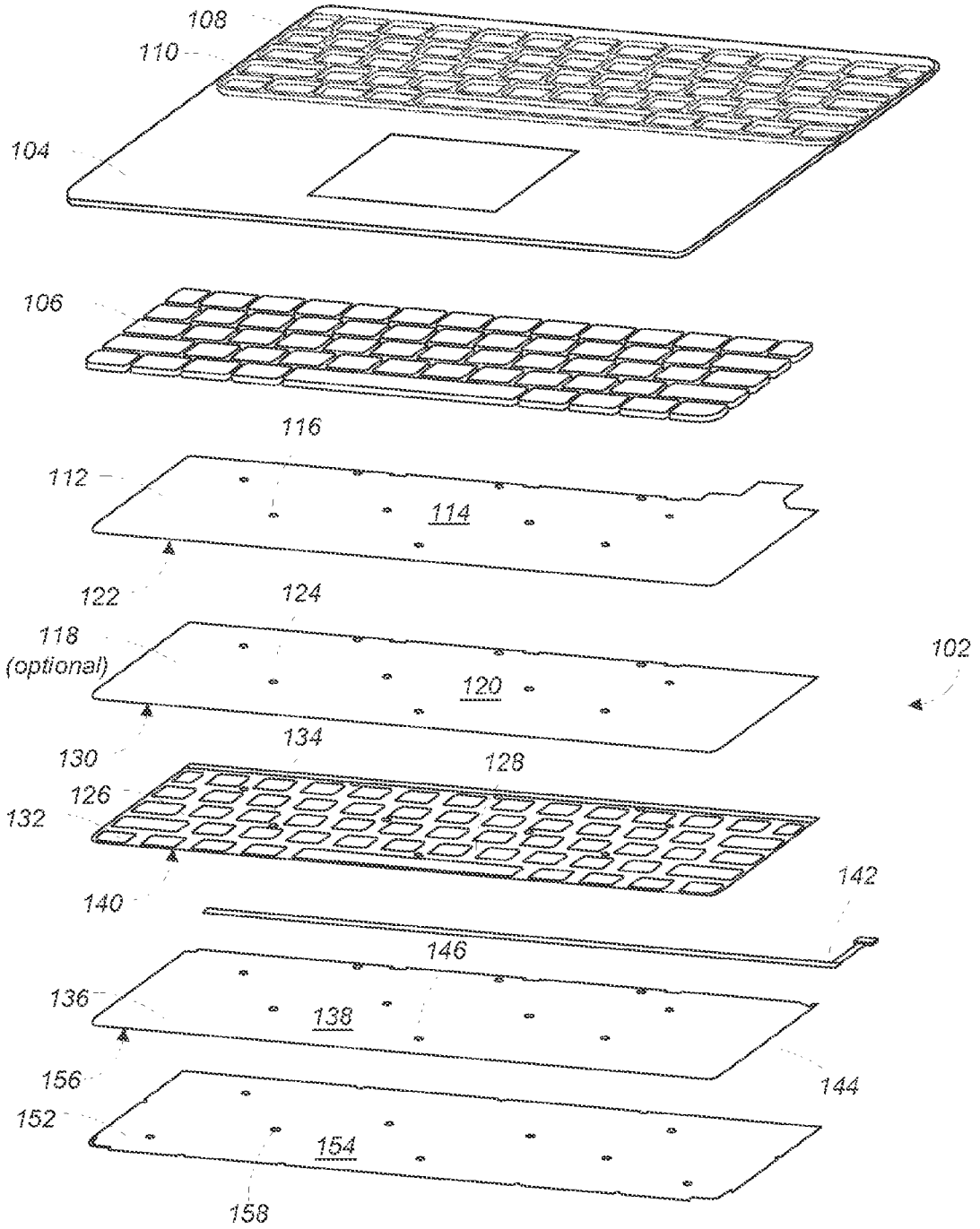
FIG. 2 shows an illustrative exploded-perspective view of a backlit keyboard assembly including a metal reflective component and a top case of an electronic device, according to embodiments.

FIG. 2 shows an illustrative exploded perspective view of backlit keyboard assembly 102 and top case 104 of electronic device 100 of FIG. 1, according to an embodiment. It is understood that similarly named components or similarly numbered components may function in a substantially similar fashion, may include similar materials and/or may include similar interactions with other components. Redundant explanation of these components has been omitted for clarity.

As shown in FIG. 2, top case 104 of electronic device 100 (see, FIG. 1) may include a plurality of keyholes 108 formed therethrough. As shown in FIGS. 1 and 2, and discussed herein, the plurality of keys 106 of backlit keyboard assembly 102 may be positioned within and may partially extend above keyholes 108 of top case 104. As a result of keyholes 108 being formed therein, top case 104 may also include skeletal ribs 110 configured to be positioned between the plurality of keys 106. That is, and as discussed herein, skeletal ribs 110 of top case 104 may substantially surround and/or may be positioned within the space between the plurality of keys 106 of backlit keyboard assembly 102.

Backlit keyboard assembly 102 may be shown as a "stack up," or a group of components positioned in layers to form backlit keyboard assembly 102. As discussed herein, the plurality of components positioned in layers may be positioned adjacent to and/or coupled to one another, and may be sandwiched between top case 104 and a bottom case (see, FIG. 3) of electronic device 100.

The stack up forming backlit keyboard assembly 102 may include a membrane 112. As shown in FIG. 2, each of the keys 106 may be positioned adjacent membrane 112. More specifically, each of the keys 106 may be positioned directly above and may be configured to interact with a first side 114 of membrane 112 during actuation. As discussed herein with respect to FIG. 3, each of the keys 106 may be coupled to a contact component (e.g., dome switch) that may be positioned between keys 106 and membrane 112. When key 106 is actuated, the contact component (see, FIG. 3) positioned between key 106 and membrane 112 may be depressed to contact an electrical trace (not shown) positioned on or adjacent to membrane 112. The electrical trace provides a key-specific electrical signal (e.g., input) to electronic device 100 when key 106 is actuated and the contact component contacts the electrical case.

In a non-limiting example, membrane 112 may be a sensing membrane that includes at least one trace or sensor (not shown) positioned directly on a side (e.g., first side 114) of membrane 112. In an additional non-limiting example, the traces or sensors (not shown) may be positioned on a component (e.g., metal feature plate) of keyboard assembly 102 adjacent to membrane 112. In the additional non-limiting example where the traces or sensors (not shown) may be positioned on a component adjacent to membrane 112, membrane 112 may allow the contact component (see, FIG. 3) positioned between the key 106 and membrane 112 to contact the trace or sensor. As discussed herein, traces or sensors positioned on, or adjacent to, membrane 112 may be configured to detect or determine when key 106 of backlit keyboard assembly 102 is actuated by a user, and subsequently provide an electrical signal (e.g., input) to electronic device. In a non-limiting example, membrane 112 may be formed from a substantially flexible, conductive material including, but not limited to an indium tin oxide (ITO) layer.

As shown in FIG. 2, membrane 112 may include a plurality of membrane openings 116 formed through membrane 112. As discussed herein, the plurality of membrane openings 116 may be positioned in substantial alignment with a plurality of distinct openings formed in the various layers of backlit keyboard assembly 102. Additionally, and as discussed herein, the plurality of membrane openings 116 may be optional, and may formed within membrane 112 dependent on, at least in part, the configuration of the distinct layers of backlit keyboard assembly 102, and the technique used to contact and/or couple the layers. Membrane openings 116 may be formed through membrane 112 to receive a coupling component to couple a bottom case (see, FIGS. 3-5) to top case 104. That is, a portion of membrane openings 116, and the distinct openings and/or apertures formed through the layers of the stack up as discussed herein, may be configured to receive a screw, snap-fit component, or other suitable coupling components positioned on or through a bottom case. The coupling component may be coupled to top case 104, to couple of fix a bottom case to the top case 104 to form an enclosure for backlit keyboard assembly 102. Additionally, and as discussed herein, the openings and/or apertures formed through the layers of the stack up, including the membrane openings 116, may be formed to aid in coupling the various layers forming keyboard assembly 102 to each other.

Backlit keyboard assembly 102 may also include a metal feature plate 118. Metal feature plate 118 may be coupled to membrane 112. More specifically, a first side 120 of metal feature plate 118 may be coupled to a second side 122 of membrane 112, opposite the plurality of keys 106 positioned on or above first side 114 of membrane 112. Metal feature plate 118 may be operably connected to the plurality of keys 106 of backlit keyboard assembly 102 via membrane 112 and, in some embodiments, may include a plurality of electrical traces or sensors (not shown), as discussed herein. When positioned on the metal feature plate 118, the electrical traces or sensors may conduct electrical signals formed on the plate, and ultimately to associated circuitry of electronic device 100, when key 106 is actuated during use of electronic device 100. The electrical signals conducted by the traces or sensors of the metal feature plate 118 may be provided to electronic device 100 and the internal components (for example, processor) of electronic device 100, indicating that a distinct key of the plurality of keys 102 of backlit keyboard assembly 102 may be actuated. Metal feature plate 118 may be formed from any suitable, electrically conductive sheet metal material including, but not limited to: aluminum, brass, and iron.

As shown in FIG. 2, metal feature plate 118 may include a plurality of metal feature plate openings 124 (hereafter, "plate openings 124") formed through metal feature plate 118. Plate openings 124 may be in substantial alignment with the plurality of membrane openings 116 formed in membrane 112, and a plurality of distinct openings formed in the various layers of backlit keyboard assembly 102, as discussed herein. Similar to the membrane openings 116, and as discussed herein, the plurality of plate openings 124 may be optional, and may formed within metal feature plate 118 dependent on, at least in part, the configuration of the distinct layers of backlit keyboard assembly 102, and the technique used to contact and/or couple the layers. As briefly discussed above with respect to membrane openings 116 formed through membrane 112, and as discussed in detail below plate openings 124 may be formed through metal feature plate 118 to receive a coupling component to couple a bottom case (see, FIGS. 3-5) to top case 104, and/or to aid in coupling the various layers forming keyboard assembly 102 to each other.

Backlit keyboard assembly 102 may also include a mask 126 contacting and/or coupled to metal feature plate 118. More specifically, a first side 128 of mask 126 may contact and/or may be coupled to a second side 130 of metal feature plate 118. As shown in FIG. 2, mask 126 may include a plurality of light holes 132 formed through mask 126. Each of the plurality of light holes 132 of mask 126 may be in partial alignment with a respective keyhole 108 formed in top case 104 and key 106. That is, each of the plurality of light holes 132 of mask 126 may be in alignment with a corresponding keyhole 108 of top case 104 and key 106, respectively. As shown in FIG. 2, each light hole 132 may be smaller than the corresponding keyhole 108 and/or key 106. However, it is understood that each light hole 132 may be larger than or equal to the size of the corresponding keyhole 108 formed in top case 104. Additionally, in other embodiments, mask 126 may include a single light hole 132 substantially the size of the plurality of keys 106 of the backlit keyboard assembly 102, or mask 126 may be completed omitted from the backlit keyboard assembly 102. Each of the plurality of light holes 132 of mask 126 may aid in concentrating or focusing the light from backlit keyboard assembly 102 on the corresponding key 106 positioned within the corresponding keyhole 108 of top case 104.

As shown in FIG. 2, mask 126 may include a plurality of mask openings 134 formed through mask 126. Mask openings 134 may be in substantial alignment with the plurality of openings (for example, membrane openings 116, plate openings 124) formed in the various layers of backlit keyboard assembly 102, as discussed herein. Dissimilar to the membrane openings 116 and plate openings 124, and as discussed herein, the plurality of mask openings 134 may be formed within mask 126 independent of the other features of backlit keyboard assembly 102. That is, and as discussed herein, at least a portion of metal feature plate 118 may be exposed or uncovered by mask 126 via the plurality of mask openings 134, independent of, at least in part, the configuration of the distinct layers of backlit keyboard assembly 102, and the technique used to contact and/or couple the layers. As discussed herein, mask openings 134 may be formed through mask 126 to receive a coupling component to couple a bottom case (see, FIGS. 3-5) to top case 104, and/or to aid in coupling the various layers forming keyboard assembly 102 to each other.

Backlit keyboard assembly 102 may include a light guide 136 positioned adjacent metal feature plate 118. More specifically, a first side 138 of light guide 136 may be coupled to and/or may contact a second side 140 of mask 126, to position light guide 136 adjacent metal feature plate 118 of backlit keyboard assembly 102. Light guide 136 may aid in providing light to the plurality of keys 106 of backlit keyboard assembly 102. More specifically, light guide 136 may be a structure that may span the entire dimension of the plurality of keys 106 of backlit keyboard assembly 102, and may aid in providing light to the plurality of keys 106 and/or the top case 104 during operation of backlit keyboard assembly 102. In an non-limiting example, light guide 136 may include a polycarbonate layer.

Although shown as two distinct layers in FIG. 2, it is understood that mask 126 may be formed on top of or as a part of light guide 136 of backlit keyboard assembly 102. That is, the pattern of light holes 132 formed within mask 126 may be implemented directly on light guide 136, such that first side 138 of light guide 136 includes the pattern of light holes 132. Where light guide 136 and mask 126 are formed as a single layer, the pattern of light holes 132 may be formed on first side 138 of light guide 136 by any suitable technique, for example, painting the pattern of light holes 132 on first side 138.

A light source 142 may be positioned on a portion of light guide 136 or positioned adjacent thereto. More specifically, light source 142 may be positioned on at least a portion of a perimeter 144 of first side 138 of light guide 136. In a non-limiting example, as shown in FIG. 2, light source 142 may be positioned on two of the four sides of perimeter 144 of light guide 136. As a result of positioning light source 142 on first side 138 of light guide 136, light source 142 may also be positioned adjacent metal feature plate 118. In a non-limiting example, light source 142 may include an LED flex. However, it is understood that light source 142 positioned on light guide 136 may include any suitable light component configured to provide light to backlit keyboard assembly 102. In another non-limiting example, light source 142 may include a group of light components (e.g., LED) positioned on or adjacent to light guide 136, where the group of light components include individual light components or a portion of the group of light components that correspond to a single key 106 of backlit keyboard assembly 102. Additionally, light source 142 may include features formed thereon to alter and/or enhance light source's 142 ability to provide light within backlit keyboard assembly 102. In a non-limiting example, light source 142 may also include a diffuser, which may spread the light emitted by light source 142 throughout the various layers of backlit keyboard assembly 102.

As shown in FIG. 2, light guide 136 may include a plurality of light guide openings 146 formed through light guide 136. Light guide openings 146 may be in substantial alignment with the plurality of openings (for example, membrane openings 116, plate openings 124, mask openings 134) formed in the various layers of backlit keyboard assembly 102, as discussed herein. Similar to the mask openings 134, and dissimilar to the membrane openings 116/plate openings 124, the plurality of light guide openings 146 may be formed within light guide 136 independent of the other features of backlit keyboard assembly 102. That is, and as discussed herein, at least a portion of metal feature plate 118 may be exposed or uncovered by mask 126 via the plurality of mask openings 134 and light guide 136 via light guide openings 146, independent of, at least in part, the configuration of the distinct layers of backlit keyboard assembly 102, and the technique used to contact and/or couple the layers.

Backlit keyboard assembly 102 may further include a metal reflector 152 positioned adjacent light guide 136. More specifically, a first side 154 of metal reflector 152 may be positioned adjacent to a second side 156 of light guide 136. Unlike various other components positioned in layers of backlit keyboard assembly 102, metal reflector 152 and light guide 136 may not be in contact with one another. That is, and as discussed herein, a space (see, FIGS. 3-5) may exist between and/or may separate first side 154 of metal reflector 152 and second side 156 of light guide 136.

Metal reflector 152 may have light-reflective properties and may be configured to reflect stray light from light source 142 back to light guide 136, and ultimately to the plurality of keys 106 and/or keyholes 108 of top case 104. More specifically, some light generated by light source 142 may not be directed toward the plurality of keys 106 and/or top case 104, but rather may stray below second side 156 of light guide 136, and may be emitted between light guide 136 and metal reflector 152. As a result of the light-reflective properties of metal reflector 152, the stray light emitted between light guide 136 and metal reflector 152 may be reflected to first side 138 and may be subsequently directed toward the plurality of keys 106 and/or keyholes 108 of top case 104 by light guide 136. In non-limiting examples, metal reflector 152 may include a stainless steel plate, an aluminum plate or other metal plates including substantially reflective properties. Additionally, and as discussed herein, metal reflector 152 may be formed from a substantially rigid material, and may form a substantially rigid end layer within backlit keyboard assembly 102 to provide a compression fit and/or structural support to at least a portion of the respective layers within keyboard assembly 102.

Although discussed herein as being formed from a metal material it is understood that reflector 152 may also be formed from a non-metal, substantially rigid materials including substantially reflective properties. That is, in other non-limiting examples, reflector 152 may be formed from a material having substantially reflective properties including plastic, ceramic, fiber-in-matrix material (e.g., carbon-fiber reinforced plastic) or other compounds. Additionally, although reflector 152 is discussed herein as a plate, reflector 152 may include a layer having portions or sections of material including substantially reflective properties. That is, in a non-limiting example, reflector 152 may include a layer of substantially rigid material including portions of reflective material that may be positioned within the rigid material in predetermined positions to aid in the reflection of light within the keyboard assembly 102, as discussed herein. The use of the non-metal material or distinct materials within reflector 152 may also aid in the coupling of reflector 152 within keyboard assembly 102, as discussed herein.

Metal reflector 152 may include a plurality of metal reflector openings 158 formed through metal reflector 152. Metal reflector openings 158 may be in substantial alignment with the plurality of openings (for example, mask openings 134, light guide openings 146) formed in the various layers of backlit keyboard assembly 102, as discussed herein. As similarly discussed above with respect to light guide openings 146, the plurality of metal reflector openings 158 may be formed within metal reflector 152 independent of the other features of backlit keyboard assembly 102. That is, and as discussed herein, at least a portion of metal feature plate 118 may be exposed or uncovered by mask 126, light guide 136, and metal reflector 152 via the plurality of metal reflector openings 158, independent of, at least in part, the configuration of the distinct layers of backlit keyboard assembly 102, and the technique used to contact and/or couple the layers.

The various openings and apertures formed through the stack up forming backlit keyboard assembly 102, as shown in FIG. 2, may receive a coupling component to couple a bottom case (see, FIGS. 3-5) to top case 104. That is, a portion of the openings and/or apertures formed through the layers of the stack up forming backlit keyboard assembly 102 may be configured to receive a screw, snap-fit component, or other suitable coupling components positioned on or through a bottom case. The coupling component may be coupled to top case 104, to couple or fix a bottom case to the top case 104 to form an enclosure for backlit keyboard assembly 102.

Figure 3:
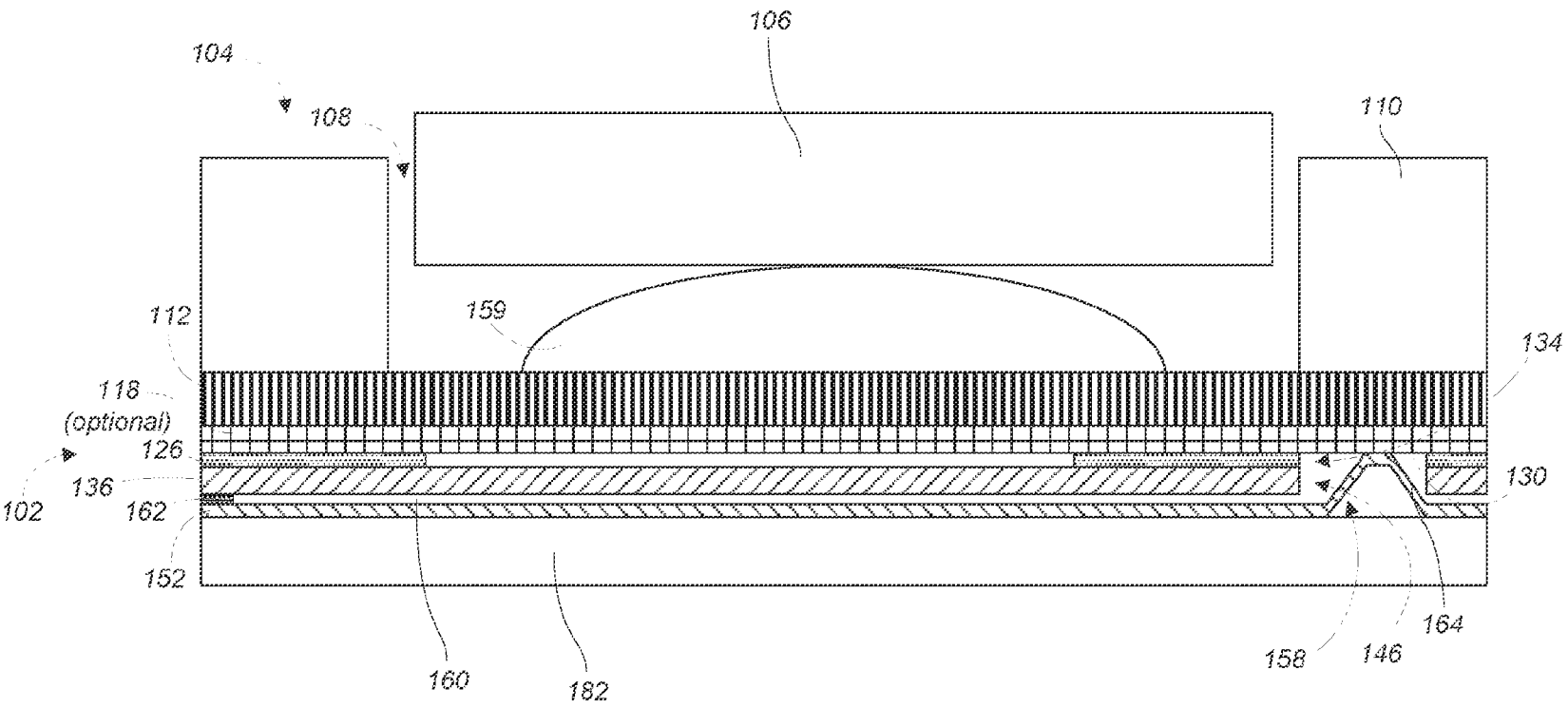
FIGS. 3-5 show illustrative cross-sectional front views of a portion of a backlit keyboard including a metal reflective component, according to various embodiments.
Figure 4:
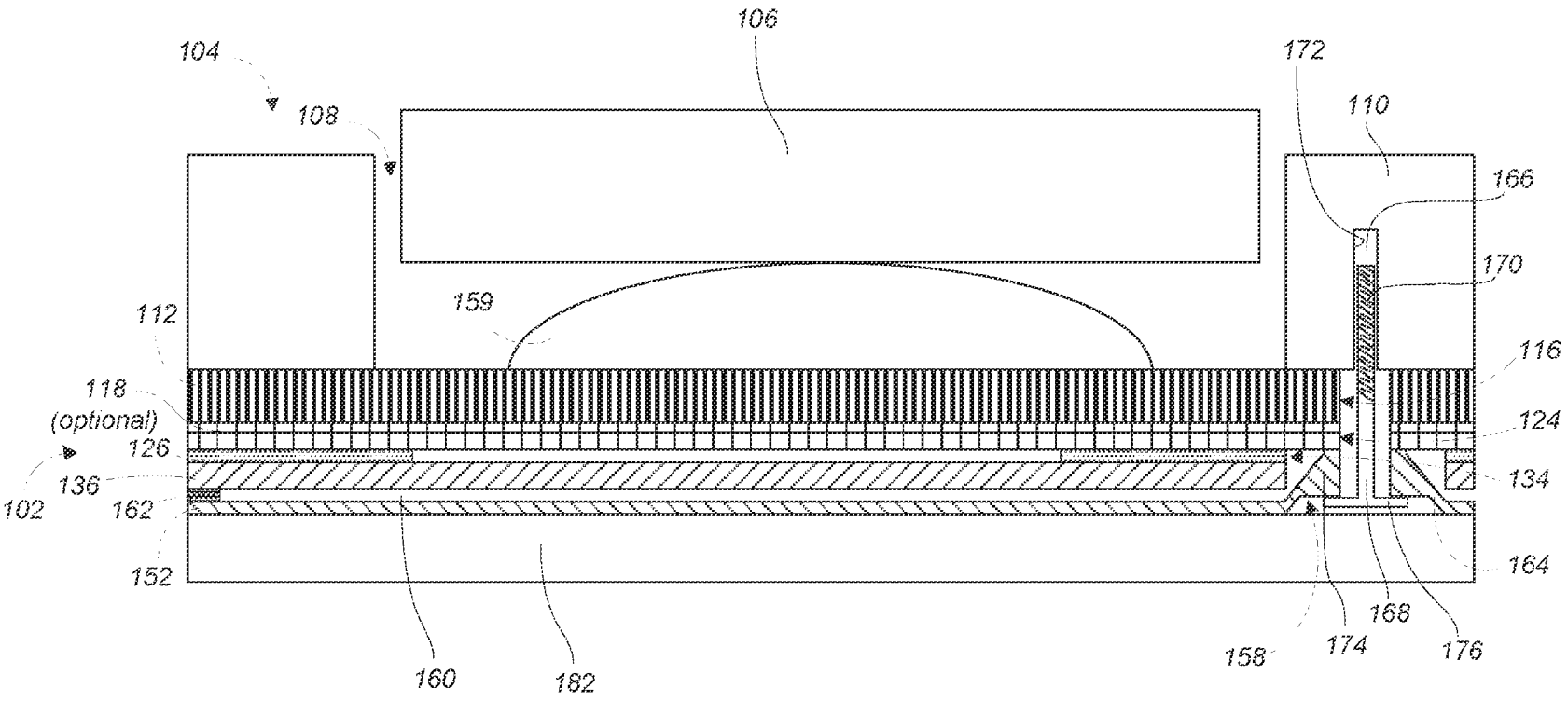
Figure 5:
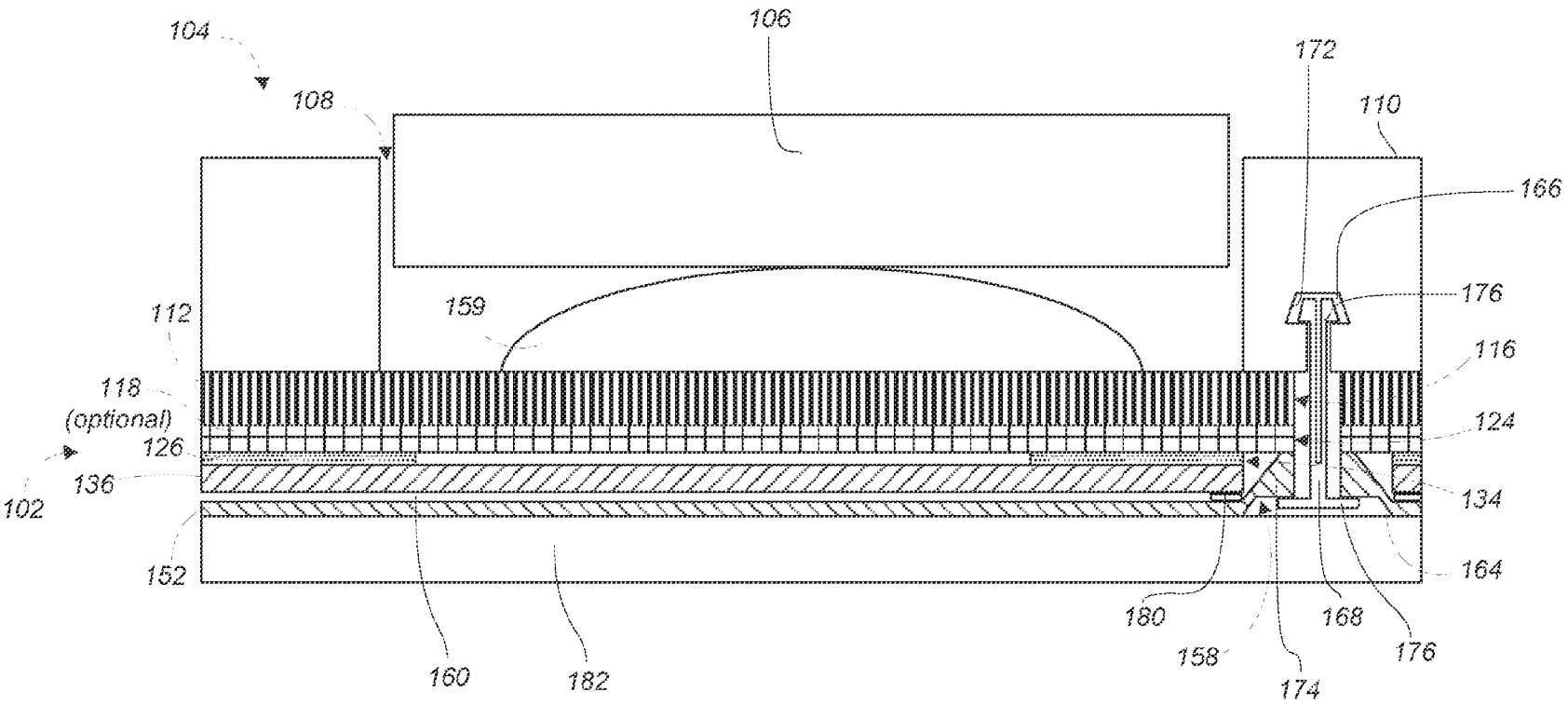

FIGS. 3-5 show illustrative cross-sectional front views of a portion of backlit keyboard assembly 102 including metal reflector 152, according to various embodiments. Specifically, FIGS. 3-5 show various embodiments of the stack up forming backlit keyboard assembly 102, as shown in FIG. 2, and how each component or layer is positioned in an assembled backlit keyboard assembly 102.

Turning to FIG. 3, backlit keyboard assembly 102 may include substantially similar components as those discussed herein with respect to FIG. 2. More specifically, backlit keyboard assemble 102 may include keys 106, membrane 112, metal feature plate 118, mask 126, light guide 136 and metal reflector 152. As discussed herein with respect to FIG. 2, each of the various layers of backlit keyboard assembly 102 may contact or may be coupled to a respective adjacent layer. For example, metal feature plate 118 may be coupled to membrane 112, and light guide 136 may contact mask 126.

As discussed herein, backlit keyboard assembly 102 may include a contact component 159 positioned between keys 106 and membrane 112. As shown in FIG. 3, contact component 159 may be a dome switch, which may be coupled to each key 106, and may be capable of compressing or substantially inverting when key 106 is actuated by a user. Additionally as discussed herein, when key 106 is actuated, dome switch (e.g., contact component 159) may be compressed such that an inner, electrically conductive surface of the dome switch may form an electrical connection with a trace or sensor (not shown) positioned on or adjacent to membrane 112. The trace or sensor may subsequently provide an electrical signal (e.g., input) to electronic device 100, as discussed herein.

As shown in FIG. 3, and discussed herein with respect to FIG. 2, a space 160 may exist between light guide 136 and metal reflector 152. More specifically, light guide 136 and metal reflector 152 may be separated by space 160 such that stray light emitted by light source 142 (see, FIG. 2) may move to space 160 and be subsequently reflected back to light guide 136 by metal reflector 152. Space 160 may be formed in backlit keyboard assembly by a spacer component 162. As shown in FIG. 3, spacer component 162 may only contact and/or cover a small portion of metal reflector 152 and light guide 162, respectively.

That is, spacer component 162 may provide space 160 between metal reflector 152 and light guide 136. In a non-limiting example, as shown in FIG. 3, space 160 formed by spacer component 162 may be wider than keyhole 108 of top case 104 and mask opening 132 of mask 126. In other non-limiting examples, space 160 may have a width that is equal to or less than the width of keyhole 108 of top case 104 and/or mask opening 132 of mask 126. As discussed herein, space 160 may aid in providing stray light emitted into space 160 back to light guide 152 and ultimately key 106 and/or keyhole 108 of top case 104.

Spacer component 162 may contact metal reflector 152 and light guide 136, but may not necessarily be coupled to the respective layers. That is, and as discussed in detail below, the coupling of metal reflector 152 within backlit keyboard assembly 102 may hold spacer component 162 in place within the backlit keyboard assembly 102 without the need to couple or fix spacer component 162 to metal reflector 152 and/or light guide 136. Spacer component 162 may be configured as any suitable rigid structure that may provide space 160 between metal reflector 152 and light guide 136.

As shown in FIG. 3, spacer component 162 may be positioned below and/or in alignment with at least a portion of skeletal rib 110 of top case 104. Spacer component 162 may be positioned in alignment with skeletal rib 110 of top case 104 to reduce any light obstruction and/or to allow light to be provided to the keys 106 and/or opening 108 within backlit keyboard assembly 102.

Metal reflector 152 may be coupled to metal feature plate 118. More specifically, a portion of metal reflector 152 may be fixed to a portion of metal feature plate 118. As shown in FIG. 3, metal reflector 152 may be coupled, fixed or joined to metal feature plate 118 using a welding technique. That is, metal reflector 152 may include an embossed portion 164 that may extend toward metal feature plate 118 through mask openings 134 and light guide openings 146, respectively. Metal reflector openings 158 may be positioned through embossed portion 164 of metal reflector 152, as shown in FIG. 3. Embossed portion 164 of metal reflector openings 158 may substantially contact and subsequently be fixed to second side 130 of metal feature plate 118 using any suitable welding technique. As discussed herein, metal feature plate 118 may also be coupled to distinct layers and/or top case 104 of backlit keyboard assembly 102 using any suitable fastener component or fastening technique (see, FIGS. 4-7). Additionally, metal feature plate 118 may be coupled to distinct layers and/or top case 104 of backlit keyboard assembly 102 using any suitable coupling component or technique including, but not limited to the use of an adhesive. Embossed portion 164 may be formed within metal reflector 152 using any suitable embossing technique, or alternatively, embossed portion 164 may be formed by performing any suitable machine process (e.g., C-N-C machining process) on metal reflector 152.

By coupling metal reflector 152 directly to metal feature plate 118, the various layers positioned between metal reflector 152 and metal feature plate 118 may be sandwiched between and/or held in place within backlit keyboard assembly 102 by a compression fit formed between the two layers. That is, metal reflector 152 may form a substantially rigid end layer within backlit keyboard assembly 102, to provide structural support to the various layers of backlit keyboard assembly 102. In addition, substantially rigid metal reflector 152 may press the various layers of the backlit keyboard assembly 102 together and/or hold the layers of backlit keyboard assembly 102 in place. Thus, metal reflector 152 and metal feature plate 118 may form a compression fit for mask 126, light guide 136 and spacer component 162 when welded together, such that metal feature plate 118, mask 126, light guide 136, spacer component 162 and/or metal reflector 152 may remain in contact without the use of adhesive or other suitable binding techniques.

As briefly discussed above, the formation of the openings (for example, membrane openings 116, plate openings 124, mask openings 134) in the various layers of backlit keyboard assembly 102 may be dependent on, or independent of, the configuration of the distinct layers of backlit keyboard assembly 102, and the technique used to contact and/or couple the layers. More specifically, openings formed in membrane 112 and metal feature plate 118 may not be present, dependent on the factors discussed above. In the example of FIG. 3, where metal reflector 152 is directly coupled to second side 130 of metal feature plate 118, membrane 112 and metal feature plate 118 may not include membrane openings 116 and plate openings 124, respectively. As such, and as shown in FIG. 3, membrane 112 and metal feature plate 118 may include a single, unitary layer when implemented in backlit keyboard assembly 102, as shown in FIG. 3.

Conversely, and as briefly discussed above, mask 126, light guide 136 and metal reflector 152 of backlit keyboard assembly 102 may include the respective openings (for example, mask openings 134, light guide openings 146) independent of the factors discussed above. That is, and as shown in FIG. 3, mask 126, light guide 136 and metal reflector 152 may include the respective openings to expose a portion of metal feature plate 118 to allow metal reflector 152 to be coupled or fixed to metal feature plate 118.

Although discussed herein as a welding technique, it is understood that metal reflector 152 may be coupled to or fixed to metal feature plate 118 using any suitable material joining technique. In non-limiting examples, metal reflector 152 may be coupled to metal feature plate 118 using a soldering technique, a brazing technique, or an adhesive joining technique.

FIG. 4 shows backlit keyboard assembly 402 according to an additional embodiment. As shown in FIG. 4, top case 104 may include a plurality of apertures 166 (although a single aperture shown for clarity) formed partially though top case 104. More specifically, top case 104 may include apertures 166 formed adjacent membrane 112 of backlit keyboard assembly 402. Further, in some embodiments the apertures 166 may not extend completely through top case 104. As discussed herein, the apertures 166 of may receive a coupling component 168 to releasably couple metal reflector 152 to top case 104. In an another non-limiting example, metal reflector 152 may be coupled to top case 104 using a suitable fixing technique, such as welding, as similarly discussed herein with respect to FIG. 3. That is, embossed portion 158 may extend to top case 104, which may or may not include apertures 166, and embossed portion of metal reflector 152 may be welded to top case 104.

Where metal reflector 152 is coupled to top case 104, as shown in FIG. 4 and discussed in detail below, the plurality of openings may be formed through all of the layers of backlit keyboard assembly 402. More specifically, and as shown in FIG. 4, membrane 112 may include membrane openings 116 and metal feature plate 118 may include plate openings 124. Additionally, as shown in FIG. 4, and as similarly discussed above with respect to FIGS. 2 and 3, mask 126 may include mask openings 134, light guide 136 may include light guide openings 146, and metal reflector 152 may include metal reflector openings 158. The respective openings of backlit keyboard assembly 402 and the apertures 166 of top case 104 may be substantially aligned with one another, and may be configured to receive coupling component 168 for releasably coupling metal reflector 152 to top case 104, as discussed herein. For example, membrane openings 116 may be in substantial alignment with apertures 166 of top case 104, and metal reflector openings 158 of metal reflector 152, respectively, and membrane openings 116, apertures 166 and metal reflector openings 158 may all be configured to receive coupling component 168.

As shown in FIG. 4, coupling component 168 may be positioned through the respective openings of backlit keyboard assembly 402 to couple metal reflector 152 to top case 104. More specifically, where coupling component 168 may be a screw, coupling component 168 may extend through the various layers of backlit keyboard assembly 402, such that a threaded portion 170 may extend into aperture 166 of top case 104. Aperture 166 of top case 104 may have corresponding threads (not shown) positioned on sidewalls 172 of aperture 166 that may engage threaded portion 170 of coupling component 168 to couple metal reflector 152 to top case 104.

Embossed portion 164 of metal reflector 152 may form an engagement component 174 positioned adjacent each of the metal reflector openings 158. Engagement component 174 may engage coupling component 168 to aid in the coupling of metal reflector 152 to top case 104. As shown in FIG. 4, engagement component 174 may extend from embossed portion 164 of metal reflector 152 toward coupling component 168, and may engage or contact an end 176 of coupling component 168. By engaging coupling component 168, engagement component 174 may aid in the coupling of metal reflector 152 to top case 104.

Additionally, engagement component 174 may aid in the coupling or contacting of the various layers of backlit keyboard assembly 402 positioned between metal reflector 152 and top case 104. That is, by coupling metal reflector 152 to top case 104 using coupling component 168, the various layers positioned between metal reflector 152 and top case 104 may be sandwiched between and/or held in place within backlit keyboard assembly 102 by a compression fit formed between the coupled components. That is, metal reflector 152 may form a substantially rigid end layer within backlit keyboard assembly 102, to provide structural support to the various layers of backlit keyboard assembly 102. In addition, substantially rigid metal reflector 152 may press the various layers of the backlit keyboard assembly 102 together and/or hold the layers of backlit keyboard assembly 102 in place. As similarly discussed above with respect to FIG. 3, reflector 152 and top case 104 may form a compression fit for membrane 112, metal feature plate 118, mask 126, light guide 136 and spacer component 162 when coupled together using coupling component 168. As a result of compression fit, membrane 112, metal feature plate 118, mask 126, light guide 136, spacer component 162 and/or metal reflector 152 may remain in contact without the use of adhesive or other suitable binding techniques.

Although discussed herein as a screw, coupling component 168 may include any suitable component configured to couple metal reflector 152 to top case 104. In a non-limiting example shown in FIG. 5, coupling component 168 of backlit keyboard assembly 502 may be a snap-fit. Snap-fit may be positioned within aperture 166 of top case 104, and may engage a shelf formed in sidewalls 172 of aperture 166 to couple snap-fit within top case 104. As similarly discussed above with respect to FIG. 4, coupling component 168, configured as a snap-fit in FIG. 5, may include end 176 which may engage engagement component 174 of metal reflector 152 when coupling metal reflector 152 to top case 104.

With comparison to FIGS. 3 and 4, backlit keyboard assembly 502 of FIG. 5 may not include spacer component 162. Rather, backlit keyboard assembly 502, as shown in FIG. 5, may include an adhesive 180 coupling a portion of metal reflector 152 to a portion of light guide 136. Similar to spacer component 162, adhesive 180 may only contact and/or cover a small portion of metal reflector 152 and light guide 136, respectively. That is, like spacer component 162, adhesive 180 may provide space 160 between metal reflector 152 and light guide 136. As such, space 160 may provide an opening to ensure that the stray light emitted within space 160 may be reflected back to light guide 152, and ultimately key 106 and/or keyhole 108 of top case 104.

Additionally, as shown in FIGS. 3-5, metal reflector 152 of backlit keyboard assembly 102, 402, 502 may be coupled to a bottom case 182 of electronic device 100 (see, FIG. 1). More specifically, where electronic device includes a top case 104 and bottom case 182, metal reflector 152 may be directly coupled to bottom case 182 using any suitable coupling technique or component. Bottom case 182 may also be coupled to top case 104 for forming a protective, exterior shell for internal components of electronic device 100, including backlit keyboard assembly 102, 402, 502. Additionally, bottom case 182 may provide further support to metal reflector 152 and/or backlit keyboard assembly 102, 402, 502. More specifically, bottom case 182 may provide further support by providing an additional compression fit, or sandwiching, the various layers of backlit keyboard assembly 102, 402, 502 between top case 104 and bottom case 182. This additional compression fit may further ensure that the various layers of backlit keyboard assembly 102, 402, 502 may not become uncoupled or uncontacted, even without the use of adhesive to bind the layers.

Figure 6:
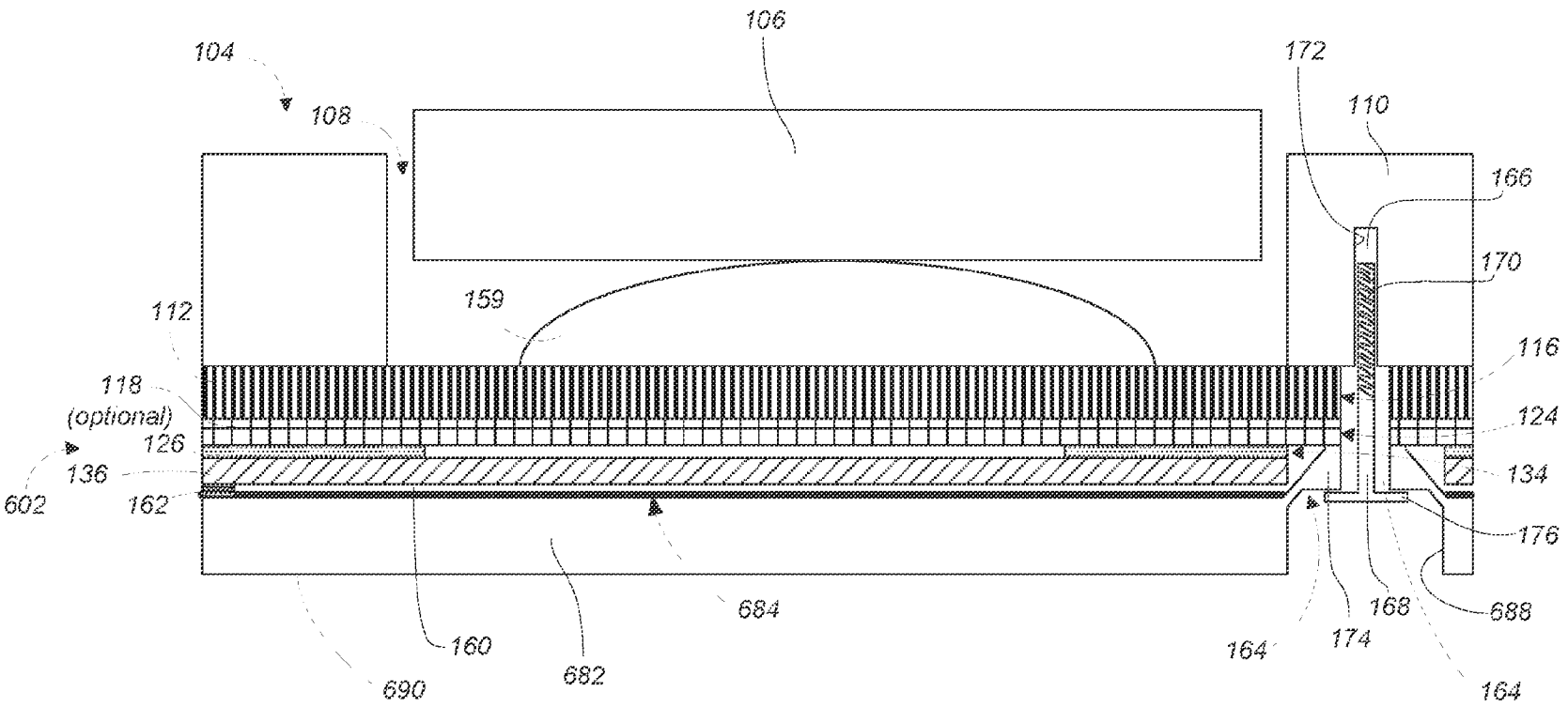
FIGS. 6 and 7 show illustrative cross-sectional front views of a portion of a backlit keyboard including a reflective metal inner surface of a bottom case, according to various embodiments.

FIG. 6 shows an illustrative cross-sectional front view of a portion of backlit keyboard assembly 602 including a reflective metal inner surface 684 of a bottom case 682, according to embodiments of the invention. As shown in FIG. 6, and in comparison to FIGS. 3-5, backlit keyboard assembly 602 may not include metal reflector 152. Instead, bottom case 682 may include a reflective metal inner surface 684. More specifically, in place of metal reflector 152, reflective metal inner surface 684 may be positioned adjacent light guide 136, and may be separated from light guide 136 by space component 162. Reflective metal inner surface 684 of bottom case 682 may be separated from light guide 136 by space 160. Reflective metal inner surface 684 of backlit keyboard assembly 602 may be configured to function substantially similar to metal reflector 152 in backlit keyboard assembly 102, as discussed herein with respect to FIGS. 3-5.

Reflective metal inner surface 684 may include substantially similar light-reflective properties as metal reflector 152. As such, during operation of backlit keyboard assembly 602, reflective metal inner surface 684 may be configured to reflect stray light from light source 142 back to light guide 136, and ultimately to the keys 106 and/or keyholes 108 of top case 104. More specifically, and as discussed herein, some light generated by light source 142 may not be directed toward the keys 106 and/or top case 104, but rather may stray below second side 156 of light guide 136, and may be positioned between light guide 136 and reflective metal inner surface 684 of bottom case 682. As a result of the light-reflective properties of reflective metal inner surface 684 of bottom case 682, the stray light positioned between light guide 136 and reflective metal inner surface 684 may be reflected to first side 138 and may be subsequently directed toward the keys 106 and/or keyholes 108 of top case 104 by light guide 136.

Reflective metal inner surface 684 may be formed on bottom case 682 using a variety of techniques and/or materials. In non-limiting example, bottom case 682 may be formed from stainless steel, aluminum or any other suitable metal having high light-reflectivity properties. When bottom case 682 is formed from a material including high light-reflectivity properties, reflective metal inner surface 684 may be consequently formed when creating bottom case 682. In an further non-limiting example where bottom case 682 is formed from a material including high light-reflectivity properties, surface treatment(s) may be performed on reflective metal inner surface 684 prior to positioning reflective metal inner surface 684 within backlit keyboard assembly 602. More specifically, reflective metal inner surface 684 may undergo a variety of surface treatment processes including, polishing, lapping and/or planing, to enhance the light-reflective properties of reflective metal inner surface 684.

As shown in FIG. 6, bottom case 682 including reflective metal inner surface 684 may include similar features as metal reflector 152 for coupling the layers of the stack up of backlit keyboard assembly 602 to each other and/or to top case 104. More specifically, bottom case 682 may include a bottom case opening 686, and an embossed portion 664 and an engagement component 674 positioned within and/or adjacent to bottom case opening 686. As shown in FIG. 6, bottom case opening 686 may be in alignment with the plurality of apertures and openings (e.g., membrane openings 116, plate openings 124, mask openings 134) formed through the various layers of the stack up forming backlit keyboard assembly 602. As similarly discussed herein with respect to metal reflector opening 158 in FIGS. 4 and 5, bottom case opening 686 may be configured to aid in coupling or securing the layers of the stack up of backlit keyboard assembly 602 to one another and/or between top case 104 and bottom case 682. More specifically, coupling component 168 may be positioned through bottom case opening 686, and may substantially engage engagement component 674 formed in embossed portion 664 of bottom case 682 for coupling bottom case 682 to top case 104. In addition, and as discussed herein with respect to FIG. 4, coupling component 168 may include threaded portion 170 which may extend into aperture 166 of top case 104, and may engage corresponding threads (not shown) positioned on sidewalls 172 of aperture 166 of top case 104 to coupled or fix bottom case 682 including reflective metal inner surface 684 to top case 104.

As shown in FIG. 6, bottom case 682 may include a recess 688 formed in alignment with bottom case opening 686. Recess 688 may be formed in bottom case 682 in order to allow coupling component 168 to be positioned substantially within bottom case 682 and/or prevent coupling component 168 from protruding beyond outer surface 690 of bottom case 682. Recess 688 may be substantially covered, and coupling component 168 may be substantially hidden during operation of electronic device 100 using any suitable component or technique. In a non-limiting example, recess 688 may be configured to receive a plug (not shown) which may substantially fill recess 688 of bottom case 682 and/or prevent coupling component 168 from being visible from outer surface 690 of bottom case 682. In an additional, non-limiting example, recess 688 may also be covered by a removable cover plate (not shown) that may cover the entire outer surface 690 of bottom case 682.

Additionally, bottom case 682 may sandwich layers via inner reflective surface 684 and spacer component 162. That is, and as similarly discussed herein, by coupling bottom case 682 including reflective metal inner surface 684 to top case 104 using coupling component 168, the various layers positioned between bottom case 682 and top case 104 may be sandwiched between and/or held in place within backlit keyboard assembly 602 by a compression fit formed between the coupled components. As similarly discussed above with respect to FIGS. 3 and 4, bottom case 682 and top case 104 may form a compression fit for membrane 112, metal feature plate 118, mask 126, light guide 136 and spacer component 162 when coupled together using coupling component 168. As a result of compression fit, membrane 112, metal feature plate 118, mask 126, light guide 136, and/or spacer component 162 may remain in contact without the use of adhesive or other suitable binding techniques.

Although shown as being substantially linear in FIG. 6, it is understood that reflective metal inner surface 684 formed on bottom case 682 may be substantially bent. More specifically, reflective metal inner surface 684 may be bent, shaped or formed within backlit keyboard assembly to extend upwards toward top case 104 and/or to be positioned through the openings and/or apertures formed in the various layers of the stack up forming backlit keyboard assembly 102. By bending or positioning a portion of reflective metal inner surface 684 within the openings and/or apertures formed in the various layers of the stack up, reflective metal inner surface 684 may further aid in redirecting light through backlit keyboard assembly 102.

Figure 7:
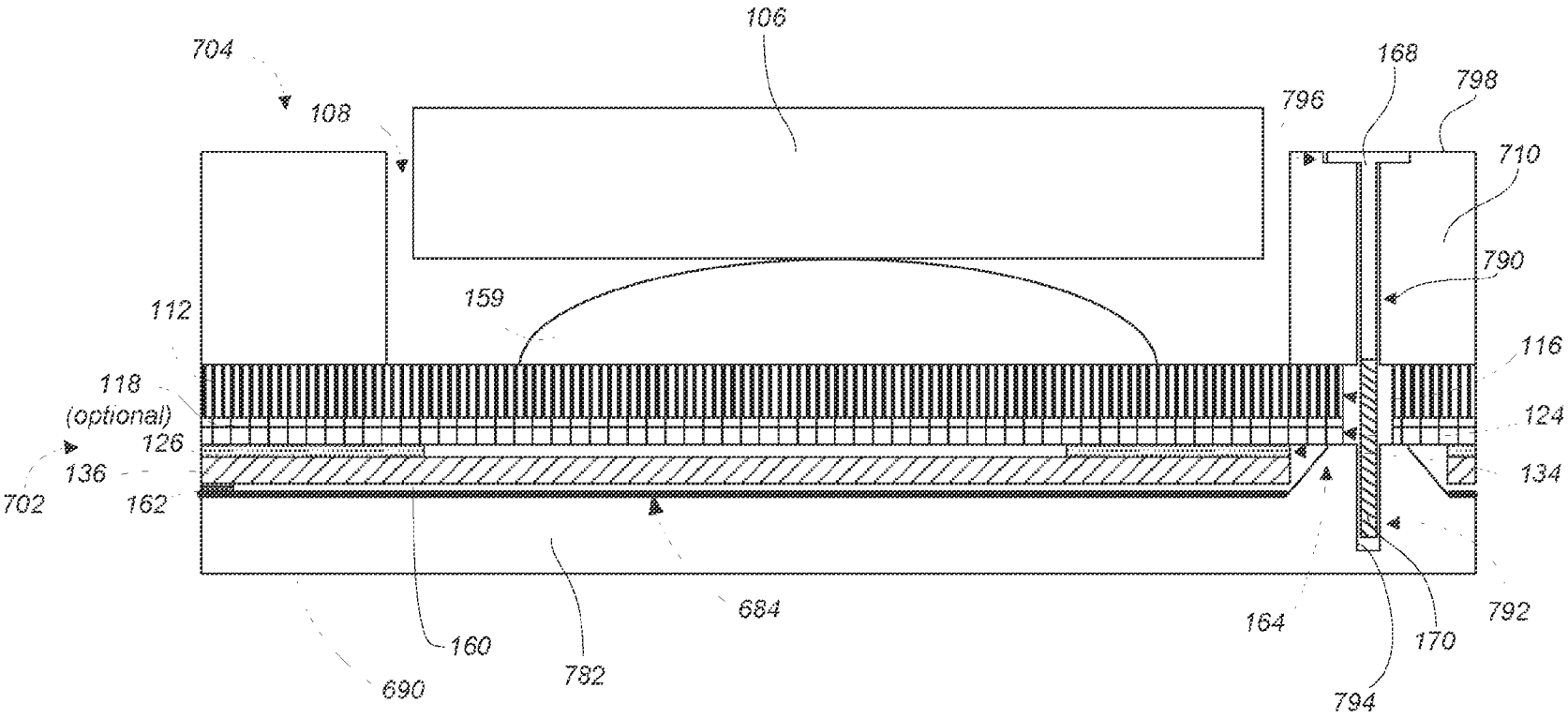

FIG. 7 shows an illustrative cross-sectional front view of a portion of backlit keyboard assembly 702 including reflective metal inner surface 684 of bottom case 782, according to embodiments of the invention. Backlit keyboard assembly 702 of FIG. 7 may include substantially similar components as backlit keyboard assembly 602 in FIG. 6. That is, backlit keyboard assembly 702 may also include bottom case 782 including reflective metal inner surface 684, as discussed herein with respect to FIG. 6. Redundant explanation of these similar components has been omitted for clarity.

As shown in FIG. 7, and distinct from FIG. 6, coupling component 168 may be positioned completely through top case 704 to couple bottom case 782 and top case 704. More specifically, top case 704 may include a top case opening 790 formed completely through skeletal ribs 710, where top case opening 790 may be configured to receive coupling component 168 to coupled bottom case 782 to top case 704. As shown in FIG. 7, top case opening 790 may be in alignment with the plurality of apertures and openings (e.g., membrane openings 116, plate openings 124, mask openings 134) formed through the various layers of the stack up forming backlit keyboard assembly 702. Top case opening 790 may also be in alignment with a bottom case partial-opening 792 formed in bottom case 782. With comparison to bottom case opening 686 in FIG. 6, bottom case partial-opening 792 of bottom case 782 may not be formed completely through bottom case 782. In a non-limiting example, and as similarly discussed herein with respect to FIGS. 4 and 6, coupling component 168 may be configured as a screw including threaded portion 170 for coupling bottom case 782 to top case 704. Coupling component 168 may be positioned through and/or received by top case opening 790, and threaded portion 170 may extend into bottom case partial-opening 792 of bottom case 782, and may engage corresponding threads (not shown) positioned on sidewalls 794 of bottom case partial-opening 792 to coupled or fix bottom case 782 including reflective metal inner surface 684 to top case 704.

Additionally, and as similarly discussed herein with respect to recess 688 of bottom case 682 in FIG. 6, top case 704 may include a recess 796. Recess 796 may be formed in top case 704 in order to allow coupling component 168 to be positioned substantially within top case 704 and/or prevent coupling component 168 from protruding beyond outer surface 798 of top case 704. Recess 796 may be substantially covered, and coupling component 168 may be substantially hidden during operation of electronic device 100 using any suitable component or technique, as similarly discussed herein with respect recess 688 shown in FIG. 6. Although shown as a distinct component in FIG. 7, coupling component 168 and top case 704 may be formed as a single, integral component for coupling top case 704 to bottom case 782, and also coupling the various layers of the stack up forming backlit keyboard assembly 702 to one another. In a non-limiting example, top case 704 may include a coupling component portion, for example a snap-fit, extending into or through the various openings and/or apertures formed within the various layers of the stack up. The integral, coupling component portion of top case 704 may positioned within opening 792 of bottom case 782, where opening 792 of bottom case 782 may receive the integral, coupling component portion of top case 704 to couple top case 704 to bottom case 782.

Figure 8:
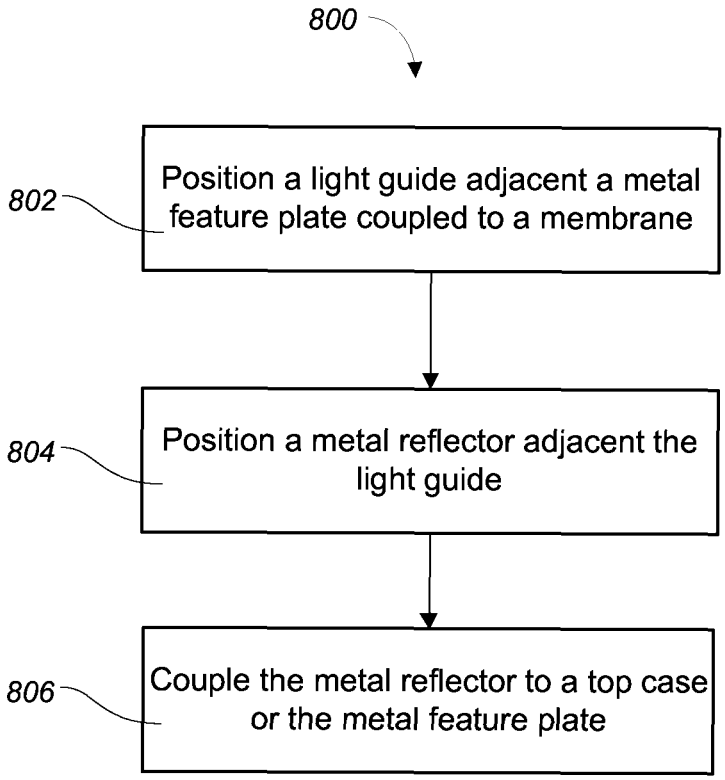
FIG. 8 shows a flow chart illustrating a method for assembling a backlit keyboard including a metal reflective component. This method may be performed on the backlit keyboard assembly as shown in FIGS. 2-7.

Turning to FIG. 8, a method for assembling a backlit keyboard 102 (see, FIG. 2) is now discussed. Specifically, FIG. 8 is a flowchart depicting one sample method 800 for assembling a backlit keyboard, as discussed herein with respect to FIGS. 2-7.

In operation 802, a light guide may be positioned adjacent to a metal feature plate coupled to a membrane. More specifically, the positioning of the light guide adjacent the metal feature plate may include coupling a mask to the metal feature plate and coupling the light guide to the mask coupled to the metal feature plate. As such, metal feature plate may be positioned between the membrane and the mask, and the mask may be positioned between the metal feature plate and the light guide. Additionally, the membrane coupled to the metal feature plate may be positioned between the metal feature plate and a top case surrounding a plurality of keys positioned on or in contact with the membrane. The light guide, the metal feature plate, the membrane, the mask, the top case and the keys may be substantially similar to the components discussed herein with respect to FIGS. 2-7.

In operation 804, a metal reflective component may be positioned adjacent the light guide. The positioning of the metal reflective component adjacent the light guide may include providing a spacer component between the metal reflective component and the light guide. The spacer component may contact the metal reflective component and the light guide. Alternatively, the positioning of the metal reflective component may include adhering a portion of the metal reflective component and a portion of the light guide to an adhesive positioned between the metal reflective component and the light guide. The spacer component and/or the adhesive positioned between the metal reflective component and the light guide may provide a space between the metal reflective component and the light guide. The space positioned there between may ensure that the metal reflective component and the light guide may be positioned adjacent one another, but may not contact one another. The metal reflective component may be substantially similar to the component discussed herein with respect to FIGS. 2-7. That is, the metal reflective component may include a metal reflective layer, as shown in FIGS. 2-5, or a reflective metal inner surface of the bottom case, as shown in FIGS. 6 and 7. Additionally, the spacer component may be substantially similar to the component discussed herein with respect to FIG. 3, and the adhesive may be substantially similar to the component discussed herein with respect to FIG. 5.

In operation 806, the metal reflective component may be coupled to the top case or the metal feature plate. Where the metal reflective component is coupled to the top case, the metal reflective component may be releasably or temporarily coupled to the top case. Alternatively, where metal reflective component is coupled to the metal feature plate, the metal reflective component may be fixed to the metal feature plate. Metal reflective component may be coupled to the top case or the metal feature plate using any suitable coupling technique or coupling component, as similarly discussed herein with respect to FIGS. 3-7.

By utilizing the metal reflector within the backlit keyboard assembly, and specifically, coupling the metal reflector layer to the top case or the metal feature plate, the various layers forming backlit keyboard assembly may be securely sandwiched between metal reflector layer and the top case. That is, the metal reflector may be utilized within the backlit keyboard assembly to form a substantially rigid end layer that may secure the various layers of the backlit keyboard assembly within the electronic device without requiring a substantial amount or any adhesive to bind the layers, and may provide structural support to the various layers as well. Additionally, the metal reflector, including light-reflective properties, may be utilized with the backlit keyboard assembly to substantially redirect or reflect stray light back to a light guide, to be subsequently provided to the keys and/or the keyholes of the top case of the backlit keyboard assembly. That is, the metal reflector may reflect stray light back to the light guide, which ultimately increase the efficiency of the backlit keyboard assembly by providing a maximum amount of light, whether directly or reflected, to the keys and/or the keyholes of the top case.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A backlit keyboard comprising:

a top case forming a top portion of an exterior surface of the keyboard;

a set of keys positioned within the top case;

a membrane positioned below the set of keys;

a light guide positioned below the membrane;

a light source positioned on a portion of the light guide and configured to emit light coupled into the light guide and emit stray light into the offset not coupled into the light guide;

a bottom case attached to the top case and forming a bottom portion of the exterior surface of the keyboard; and a reflector positioned on an interior surface of the bottom case below the light guide; and a spacer positioned between the light guide and the reflector, the spacer defining a gap between the light guide and the reflector, wherein:

the reflector is configured to redirect the stray light towards the set of keys;

the reflector includes a plurality of reflector openings configured to receive a coupling component;

the reflector is coupled to the top case via the coupling component; and the reflector provides structural support for the light guide.

2. The backlit keyboard of claim 1, wherein the reflector is releasably coupled to the top case.

3. The backlit keyboard of claim 2, further comprising a plurality of apertures formed partially through the top case, adjacent the membrane, wherein the plurality of apertures are configured to receive the coupling component for releasably coupling the reflector to the top case.

4. The backlit keyboard of claim 3, further comprising:

a plurality of membrane openings formed through the membrane, wherein the plurality of membrane openings are substantially aligned with the plurality of apertures formed partially through the top case.

5. The backlit keyboard of claim 3, wherein:

a plurality of reflector openings are in substantial alignment with the plurality of apertures formed partially through the top case;

the plurality of reflector openings are configured to receive the coupling component for releasably coupling the reflector to the top case; and the reflector further includes an engagement component positioned within each of the plurality of reflector openings, the plurality of engagement components configured to engage the coupling component.

6. The backlit keyboard of claim 3, wherein the light guide includes a plurality of light guide openings in substantial alignment with the plurality of apertures formed partially though the top case, wherein the plurality of light guide openings are configured to receive the coupling component for releasably coupling the reflector to the top case.

7. A computing device comprising:

a top case forming a top portion of an exterior surface of the device; and a keyboard assembly positioned within the top case, the keyboard assembly comprising:

a set of keys;

a light guide configured to direct light toward the plurality of keys; and a light source configured to emit light coupled into the light guide and emit stray light that is not coupled into the light guide; and a bottom case attached to the top case and forming a bottom portion of the exterior surface of the device, the bottom case comprising:

a reflector positioned on an interior surface of the bottom case below the light guide and separated from the light guide by a spacer, wherein:

the spacer is configured to maintain a gap between the light guide and the reflector;

the reflector is configured to redirect the stray light toward the set of keys; and the reflector provides structural support for the light guide via a coupling component that secures the reflector to the top case.

8. The computing device of claim 7, wherein the light source is positioned on at least a portion of a perimeter of the light guide.

9. The computing device of claim 7, wherein the keyboard assembly further comprises a mask positioned adjacent to the light guide.

10. The computing device of claim 9, wherein the keyboard assembly further comprises:

a plurality of mask openings formed through the mask;

a plurality of light guide openings formed through the light guide, the plurality of light guide openings substantially aligned with the plurality of mask openings; and wherein a plurality of reflector openings are substantially aligned with the plurality of light guide openings.

11. A method for assembling a keyboard, the method comprising:

positioning a keyboard assembly within a top case, the top case forming a top portion of an exterior surface of the keyboard, wherein the keyboard assembly comprises:

a light guide configured to direct light from a light source toward a set of keys; and a light source configured to emit light coupled into the light guide and emit stray light not coupled into the light guide;

attaching a bottom case to the top case, the bottom case forming a bottom portion of the exterior surface of the keyboard, the bottom case comprising:

a reflector on an interior surface of the bottom case that is offset from the light guide by a spacer, wherein the reflector is configured to redirect stray light toward the set of keys; and coupling the reflector to the top case via a coupling component such that the reflector provides structural support to the light guide, wherein the reflector is configured to redirect the stray light toward the set of keys.

12. The method of claim 11, wherein the attaching the bottom case to the top case further comprises providing the spacer component between the reflector and the light guide, wherein the spacer component contacts the reflector and the light guide.

13. The method of claim 11, wherein the attaching the bottom case to the top case releasably couples the reflector to the top case.

* * * * *